US008422722B2

(12) United States Patent
Maurer et al.

(10) Patent No.: US 8,422,722 B2
(45) Date of Patent: Apr. 16, 2013

(54) AUDIO SPEAKER GRILL MOUNTING SYSTEM

(75) Inventors: Ronald D. Maurer, Carlsbad, CA (US); Sean P. McDermott, El Cajon, CA (US); Richard P. Apgar, Lakeside, CA (US)

(73) Assignee: Three Amigos LLC, El Cajon, CA (US)

( * ) Notice: Subject to any disclaimer, the term of this patent is extended or adjusted under 35 U.S.C. 154(b) by 492 days.

(21) Appl. No.: 12/548,864

(22) Filed: Aug. 27, 2009

(65) Prior Publication Data

US 2010/0054523 A1 Mar. 4, 2010

Related U.S. Application Data

(60) Provisional application No. 61/093,061, filed on Aug. 29, 2008.

(51) Int. Cl.
*H04R 1/02* (2006.01)

(52) U.S. Cl.
USPC ..... 381/391; 381/386

(58) Field of Classification Search ..... 381/395, 381/391, 386; 181/141
See application file for complete search history.

(56) References Cited

U.S. PATENT DOCUMENTS

| | | | | |
|---|---|---|---|---|
| 4,503,292 | A * | 3/1985 | Johnson et al. | 381/391 |
| 4,993,511 | A * | 2/1991 | Hiraki et al. | 181/150 |
| 5,445,375 | A * | 8/1995 | Sweeny | 473/570 |
| 5,699,438 | A * | 12/1997 | Smith et al. | 381/386 |
| 5,867,583 | A * | 2/1999 | Hazelwood et al. | 381/395 |
| 5,894,514 | A * | 4/1999 | Hsh | 379/437 |
| 6,661,898 | B2 * | 12/2003 | Kuwabara | 381/87 |
| 2005/0147271 | A1 * | 7/2005 | Shain | 381/386 |
| 2007/0177754 | A1 * | 8/2007 | Kemmerer | 381/391 |
| 2009/0245567 | A1 * | 10/2009 | Egyud et al. | 381/395 |

FOREIGN PATENT DOCUMENTS

GB 2201859 A * 9/1988

* cited by examiner

*Primary Examiner* — Duc Nguyen
*Assistant Examiner* — Phan Le
(74) *Attorney, Agent, or Firm* — McKee, Voorhees & Sease, P.L.C.

(57) ABSTRACT

An audio speaker assembly is provided with a grill which twist locks with the speaker housing for assembly and disassembly. The housing includes a perimeter edge with a plurality of slots and tab retainers. The grill includes a perimeter edge with a plurality of tabs. The tabs of the grill align with the slots of the housing, and the grill is then rotated so that the tabs under lay the tab retainers so as to lock the grill into securement with the speaker housing. The grill is rotated in the opposite direction to unlock the grill for disassembly.

14 Claims, 4 Drawing Sheets

AUDIO SPEAKER GRILL MOUNTING SYSTEM

CROSS-REFERENCE TO RELATED APPLICATIONS

This application claims priority under 35 U.S.C. §119 to provisional application Ser. No. 61/093,061 filed Aug. 29, 2008, herein incorporated by reference in its entirety.

FIELD OF THE INVENTION

The present invention generally relates to an improved system for mounting a speaker grill to a speaker housing. More particularly, the improved grill mounting system utilizes a twist lock assembly between the grill and the housing for quick, easy and secure mounting of the grill to the housing.

BACKGROUND OF THE INVENTION

Audio speaker assemblies generally include a housing to support the driver and tweeter, and a grill mounted on the housing to cover the driver and speaker to prevent damage to the speaker components. Grills are mounted to the housing, or baffle, in two different ways. One technique for mounting the grill to the housing is to provide a side wall or skirt extending rearwardly from the front face of the grill, with the side wall or skirt being press fit into a recess or slot in the plastic baffle. However, this press-fit technique is inconsistent, in that the plastic baffle often is distorted due to over tightening of the baffle to other housing structure. Inconsistent press-fit between the grill and the baffle may cause the grill to fall due to speaker vibrations, particularly if the speaker assembly is mounted in the ceiling, such that the grill is facing downwardly.

A second technique for mounting the grill to the housing or baffle is the use of magnets. However, the magnets generally are light weight, without a strong attraction force. For example, in commercially available speaker assembly, the magnets which mount the grill to the housing require approximately 2.5 pounds of force to remove the grill. If the mounting surface of the housing to which the grill is mounted is not perfectly flat, the magnetic force is further weakened, thereby increasing the probability of the grill falling from the housing.

Therefore, a primary objective of the present invention is the provision of an improved audio speaker grill mounting system.

Another objective of the present invention is the provision of an audio speaker assembly having a housing for supporting the speaker components and a cover or grill which is twist-locked into securement on the housing.

Yet another objective of the present invention is the provision of an improved audio speaker assembly having a grill which will not accidentally fall from the speaker housing.

Still another objective of the present invention is the provision of a method of quickly, easily, and securely mounting a speaker grill to a speaker housing.

Another objective of the present invention is the provision of a twist lock method for assembling a speaker grill to a speaker housing.

A further objective of the present invention is the provision of a speaker grill which is locked to a speaker housing by rotation of the grill relative to the housing.

Yet another objective of the present invention is the provision of a speaker grill and speaker housing which are assembled via overlapping tabs and tab retainers.

A further objective of the present invention is the provision of an improved audio speaker grill mounting system which is economical to manufacture, simple to assemble, and effective in use.

These and other objectives will become apparent from the following description of the invention.

SUMMARY OF THE INVENTION

The improved speaker assembly of the present invention includes structure for mounting the grill to the speaker housing which precludes accidental falling of the grill from the housing. More particularly, the grill is mounted to the speaker housing using a twist-lock motion, wherein rearwardly extending tabs on the grill are received in through slots in the peripheral edge of the housing. The grill is then rotated in a clockwise direction so that the tabs on the grill overlap and engage tab retainers on the housing edge so as to securely lock the grill and housing together. Ramps and/or detents may be provided on either the grill or the housing edge to tighten the lock between the grill and housing. The grill tabs are flexible so as to accommodate uneven surfaces on the edge of the housing. The grill and housing can be quickly and easily assembled and disassembled via the rotatable twist-lock feature.

DETAILED DESCRIPTION OF THE INVENTION

Figure 1:
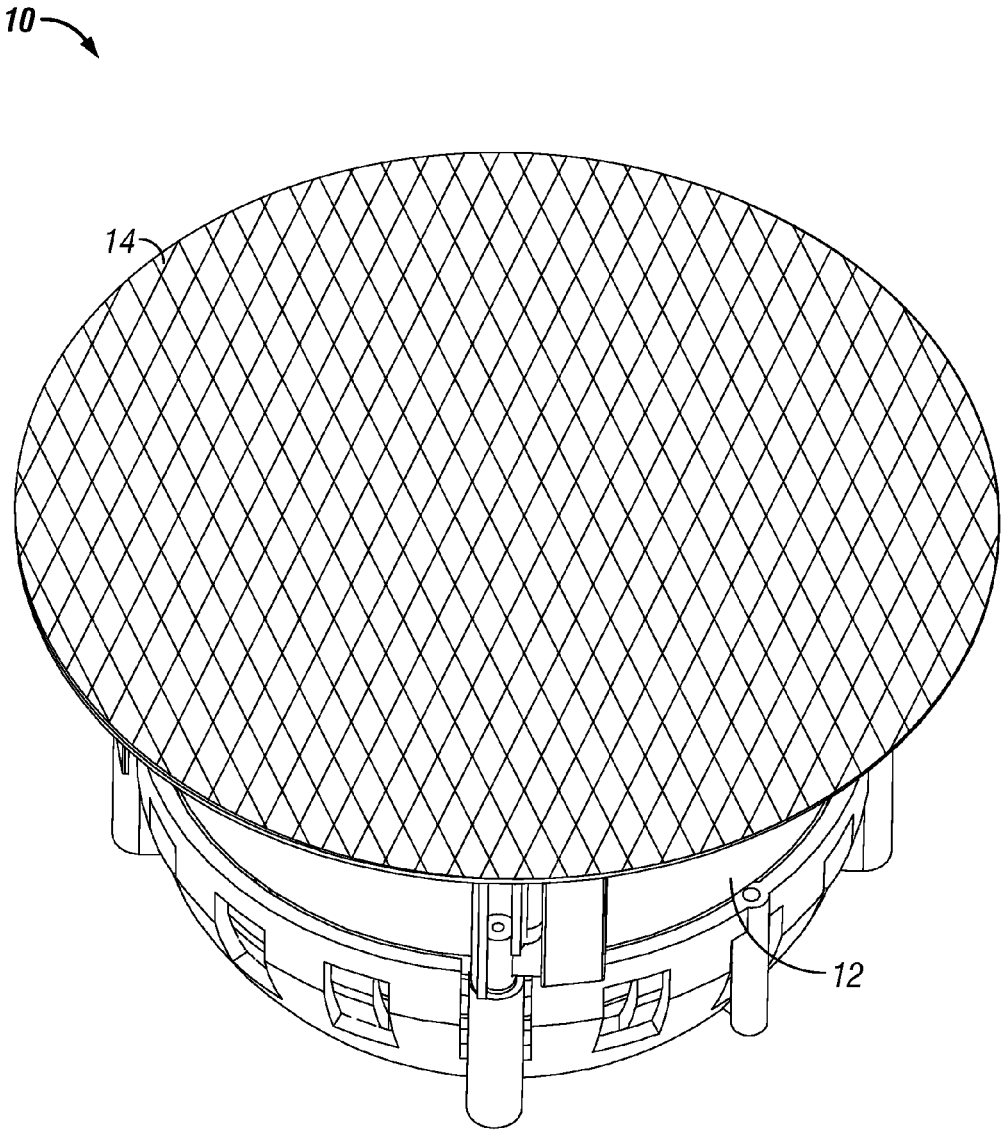
FIG. 1 is a perspective view of the speaker assembly according to the present invention.
Figure 2:
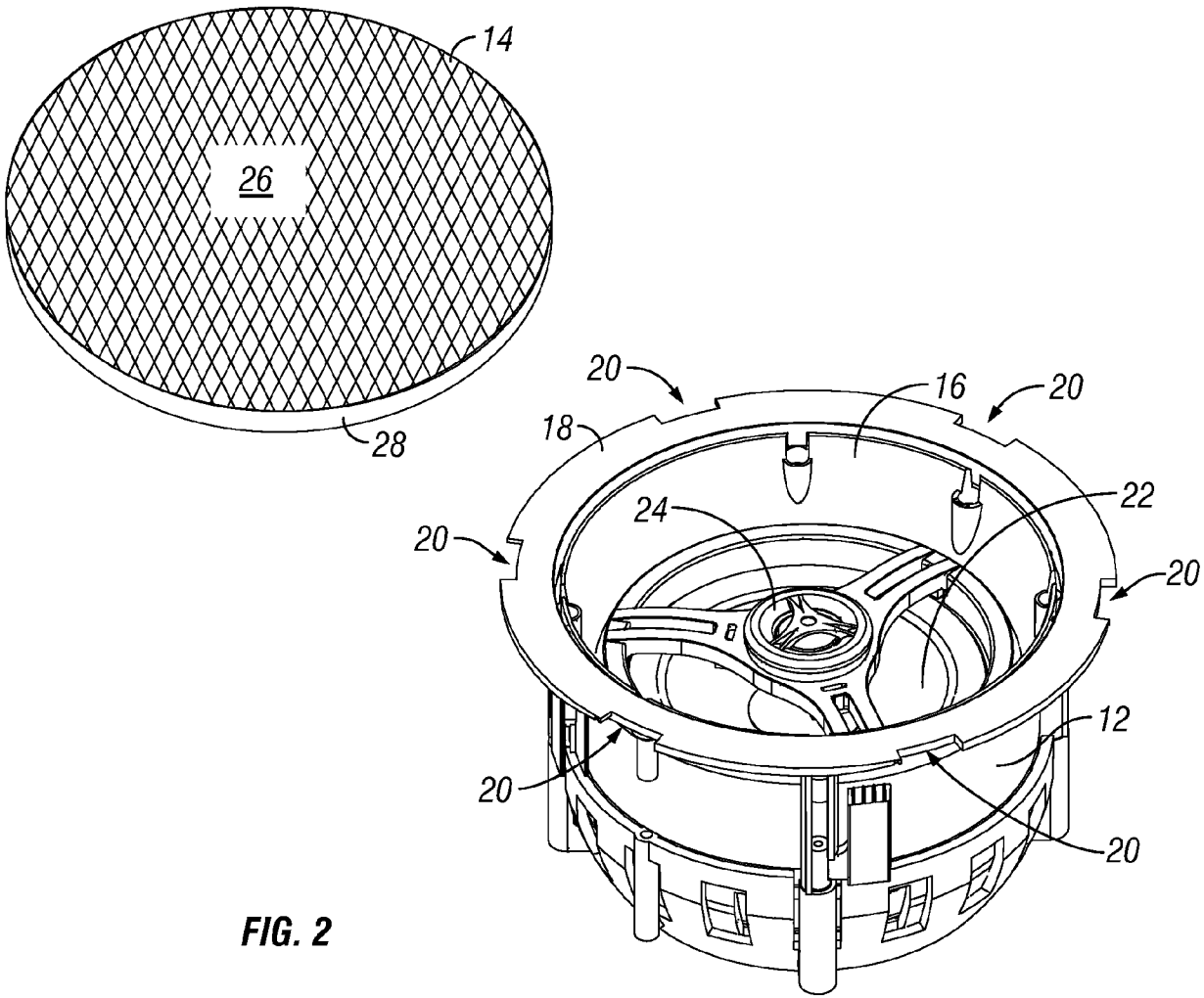
FIG. 2 is an exploded perspective view of the housing and grill for the speaker assembly.
Figure 3:
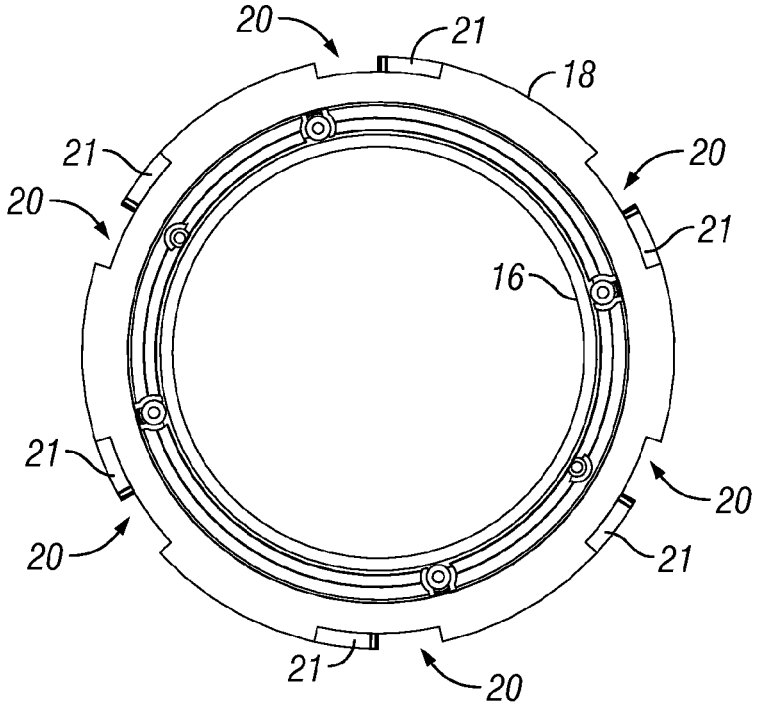
FIG. 3 is a front plan view of the baffle showing the slots on the peripheral edge.
Figure 4:
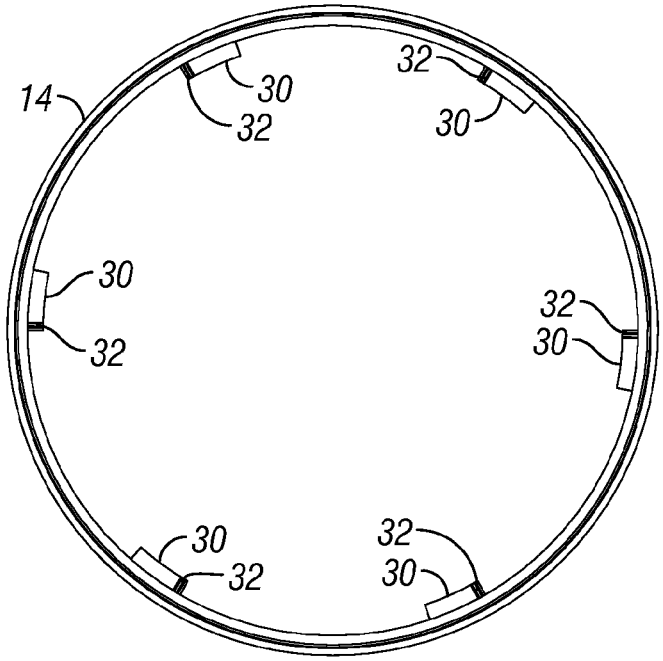
FIG. 4 is a rear plan view of the grill showing the tabs for twist-lock connection between the grill and the housing of the speaker assembly.

A speaker assembly according to the present invention is generally designated by the reference numeral 10 in the drawings. The assembly includes a housing 12 and a grill 14. The housing 12 includes a front baffle 16 having a perimeter edge 18 with a plurality of slots or notches 20 spaced around the edge 18. An audio driver or woofer 22 and a tweeter 24 are mounted in the housing. A tab retainer 21 is located adjacent each notch 20.

The grill 14 includes a front face 26 with a perimeter edge 28. A plurality of tabs 30 extend radially inwardly from the edge 28 on a rear portion of the grill 14 opposite the front face 26. The tabs 30 may be integrally formed on the grill 14 or may be attached to the grill. For example, the tabs 30 may be formed on a ring which is attached to the grill 14, or may be individually attached to the grill 14.

The grill 14 is mounted to the baffle 16 using a twist-lock motion. More particularly, the tabs 30 on the grill 14 are aligned with the slots 20 and pushed therethrough. Then, the grill 14 is rotated so that the tabs 30 slide behind the edge 18 of the baffle 16 for overlapping engagement with tab retainers 21. The twist-lock motion secures the grill 14 to the housing 12 and precludes accidental falling or separation of the grill 14 from the housing 12.

Figure 5:
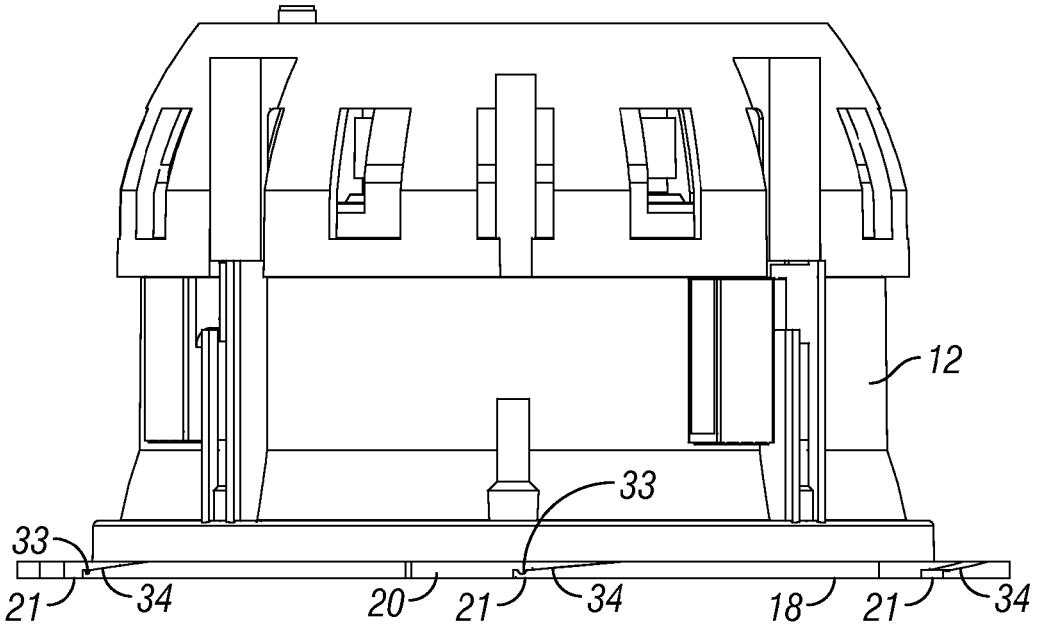
FIG. 5 is an elevation view showing the ramped tab retainer on the speaker housing.

Detents 32, 33 may be provided on either the grill 14 and/or the tab retainer 21 to further tighten the connection therebetween. Also, the tab retainers 21 or the tabs 30 of the grill 14 may include ramped surfaces 34, as seen in FIG. 5, to further tighten the connection between the grill 14 and the housing 12.

It is understood that the notches 20, tab retainers 21, and tabs 30 can be reversed on the housing 12 and the grill 14. For example, the notches and tab retainers can be formed on the grill, while the tabs can be formed on the perimeter edge 18 of the housing 12. This reversal of these components provides an equivalent structure and function to the housing 12 and grill 14 shown in FIGS. 1-5. With these reversed components, notches on the grill are quickly and easily aligned with the tabs on the housing, with the grill then being rotated to create a twist lock assembly and disassembly of the grill and housing.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved audio speaker assembly including a woofer and a tweeter, comprising:

a housing having a baffle with a circular front peripheral edge, and the woofer and the tweeter being mounted in the housing;

a speaker mounted in the housing;

a grill mounted to the housing in covering relation to the speaker;

the housing edge including a plurality of notches extending radially inwardly from the edge;

the grill having a plurality of tabs extending radially inwardly from a perimeter edge and adapted to fit through the notches whereby the grill is twist-locked into securement on the housing;

one of the peripheral edge of the housing or the tab of the grill having a ramped surface to adjustably tighten the twist lock between the grill and the housing; and a plurality of detents on the ramped surface to adjustably lock the grill to the housing.

2. The speaker assembly of claim 1 wherein the grill tabs extend behind the peripheral edge of the housing.

3. A method of assembling a speaker grill to a speaker housing having a center axis and in which a woofer and a tweeter are mounted, comprising:

positioning the grill over the housing so that radially inwardly extending tabs on the grill align with radially outwardly open notches in the housing;

pushing the tabs through the notches;

twisting the grill in a first direction about the center axis relative to the housing so that the tabs rotate beyond the notches to overlap a portion of the housing and thereby lock the grill to the housing so as to cover the woofer and the tweeter;

the twisting being to variable degrees so as to adjust the tension between the grill and the housing; and the degree of twisting varying the depth of mounting between the housing and the grill.

4. The method of claim 3 further comprising tightening the overlapped grill tab and the housing portion with a ramped surface.

5. The method of claim 3 further comprising securing the overlapped grill tabs and housing portion with a detent.

6. The method of claim 3 wherein the grill twists in an opposite direction relative to the housing so as to unlock the grill from the housing.

7. A speaker assembly, comprising:

a housing;

an audio speaker mounted in the housing;

a grill being mounted around the housing and twist locked in a selected one of multiple positions onto the housing to cover the audio speaker;

a plurality of detents on one of the housing edge or grill to adjustably lock the grill to the housing; and the locked position being selected by the degree of twist lock rotation;

wherein one of the grill and housing includes tabs and the other of the grill and housing includes tab retainers, the tabs and tab retainers initially being offset before the grill is twist-locked onto the housing and then the tabs and tab retainers overlapping one another when the grill is twist-locked onto the housing; and notches adjacent the tab retainers for receiving the tabs.

8. The speaker assembly of claim 7 wherein the tabs and tab retainers extending radially inwardly from a perimeter edge of one of the grill and the housing.

9. The speaker assembly of claim 1 wherein the detents allow the grill to be locked in more than one position.

10. The speaker assembly of claim 9 wherein the locked position is selected by the degree of twist lock rotation.

11. The speaker assembly of claim 1 wherein the grill has a perimeter edge enclosing the peripheral edge of the housing.

12. The speaker assembly of claim 7 wherein the grill has a perimeter edge extending outside a perimeter edge of the housing.

13. The speaker assembly of claim 1 wherein the detents provide adjustable depth between the housing and the grill.

14. The speaker assembly of claim 7 wherein the selected position varies a mounting depth between the housing and the grill.

* * * * *